US007419354B2

(12) United States Patent
Zamfes

(10) Patent No.: US 7,419,354 B2
(45) Date of Patent: Sep. 2, 2008

(54) CENTRIFUGAL PUMP WITH SCREW PUMP ACCELERATOR

(76) Inventor: Konstandinos Zamfes, 1830-10 Ave SW., Calgary (CA) T3C 0J8

( * ) Notice: Subject to any disclaimer, the term of this patent is extended or adjusted under 35 U.S.C. 154(b) by 0 days.

(21) Appl. No.: 10/907,485

(22) Filed: Apr. 2, 2005

(65) Prior Publication Data

US 2005/0238479 A1 Oct. 27, 2005

Related U.S. Application Data

(60) Provisional application No. 60/521,343, filed on Apr. 5, 2004.

(51) Int. Cl.
*F04D 1/04* (2006.01)

(52) U.S. Cl. ..... 415/198.1; 415/71; 415/118; 415/199.3; 415/199.4; 415/199.6

(58) Field of Classification Search ..... 415/71, 415/72, 73, 118, 143, 198.1, 199.3, 199.4, 415/199.6, 201
See application file for complete search history.

(56) References Cited

U.S. PATENT DOCUMENTS

| | | | | | |
|---|---|---|---|---|---|
| 718,557 | A * | 1/1903 | Wenzel | 415/199.6 |
| 1,711,045 | A * | 4/1929 | Davis | 415/72 |
| 2,857,081 | A * | 10/1958 | Lung | 415/199.6 |
| 4,531,892 | A * | 7/1985 | Nasman et al. | 415/71 |
| 4,884,943 | A * | 12/1989 | Niskanen | 415/143 |
| 4,976,586 | A * | 12/1990 | Richter et al. | 415/143 |
| 6,960,061 | B2 * | 11/2005 | Wagner | 415/169.1 |

* cited by examiner

*Primary Examiner*—Igor Kershteyn
(74) *Attorney, Agent, or Firm*—Diederiks & Whitelaw PLC

(57) ABSTRACT

Method and apparatus for pumping drilling fluid (mud) containing drill cuttings, comprising a centrifugal pump with screw pump accelerator. The screw pump creating positive pressure for centrifugal pump inlet to increase performance. The screw pump mud level fluctuations are compensated by the vertical screw pumping unit. Adjusting the elevation of pump will adjust the quantity of mud pumping, which is not possible with ether one pump alone. Air is allowed to mix with the mud in the centrifugal pump to create air bubbles to decrease density of the mixture and decrease the head pressure.

7 Claims, 2 Drawing Sheets

CENTRIFUGAL PUMP WITH SCREW PUMP ACCELERATOR

CROSS REFERENCE TO RELATED APPLICATIONS

The present application is a continuation of provisional Application Ser. No. 60/521,343 filed on Apr. 5, 2004, which is incorporated by reference herein.

BACKGROUND OF INVENTION

During the drilling of a well, mud is circulated down hole to carry away drilling cuttings. On the surface the mud is recirculated in different tanks using pumping units for delivering the mud to de-silter and de-sander. This pump is delivering the mud to the sample catcher, which need consistent flow for analytical measurement on drilling cuttings contained in the mudflow.

SUMMARY OF INVENTION

The invention relates to apparatus for pumping drilling mud with cuttings collected from active mud systems to the necessary height of reservoir. Specifically the pumping is performed in the field from possum belly to the sample catcher. The invention is providing the means for compact, portable and flow quantity adjustable pumping device for confined space as possum belly on the shale shaker.

BRIEF DESCRIPTION OF DRAWINGS

On FIG. 1 is presented a general view of Centrifugal Pump with crew pump accelerator.

1.1 The container of centrifugal part of pump.
1.2 The container of screw pumps part.
1.3 Motion axle.
1.4 Motor.
1.5 Screw pumps blades body.
1.6 Centrifugal pump body flat 90-degree wings.
1.7 Centrifugal pump body twisted 45-degree wings.
1.8 Air inlet upper window.

Figure 2:
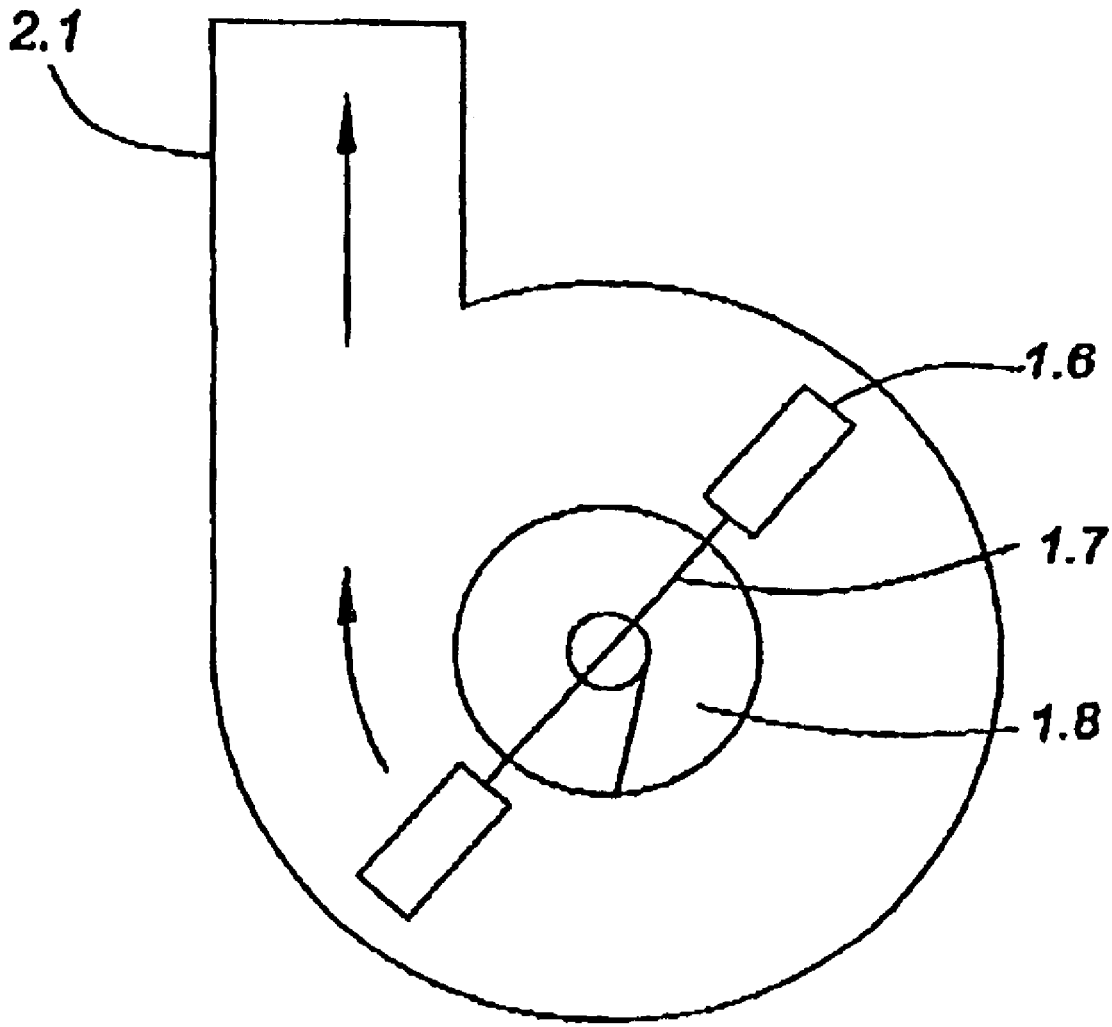

On FIG. 2 is top view of Centrifugal pump body.

2.1 Output spout.
1.6 Centrifugal pump body flat 90-degree wings.
1.7 Centrifugal pump body twisted 45-degree wings.
1.8 Air inlet upper window.

DETAILED DESCRIPTION

We disclose an apparatus and process for Centrifugal Pump with screw pump accelerator. The apparatus consisting from Centrifugal type pumping unit FIG. 1 (1.1) to which in central part is added a screw pump FIG. 1 (1.2). The centrifugal motion is horizontally oriented on vertical axle, FIG. 1 (1.3) and on the same axle below is placed the screw pump with vertical motion orientation FIG. 1. The liquid/drilling mud is pumped up by Screw pumping unit creating positive pressure for centrifugal pump. This positive pressurizing is increasing the performance in 3 ways:

The mud level fluctuations that are very common on the drilling rigs are compensated by vertical screw pumping unit. Also by adjusting the level of pump one can adjust the quantity of mud pumping which is not possible with either one pump. The centrifugal pump has to be submersed, this pumping is in full power, and no regulation and a screw pump pumps full power, no regulation.

Figure 1:
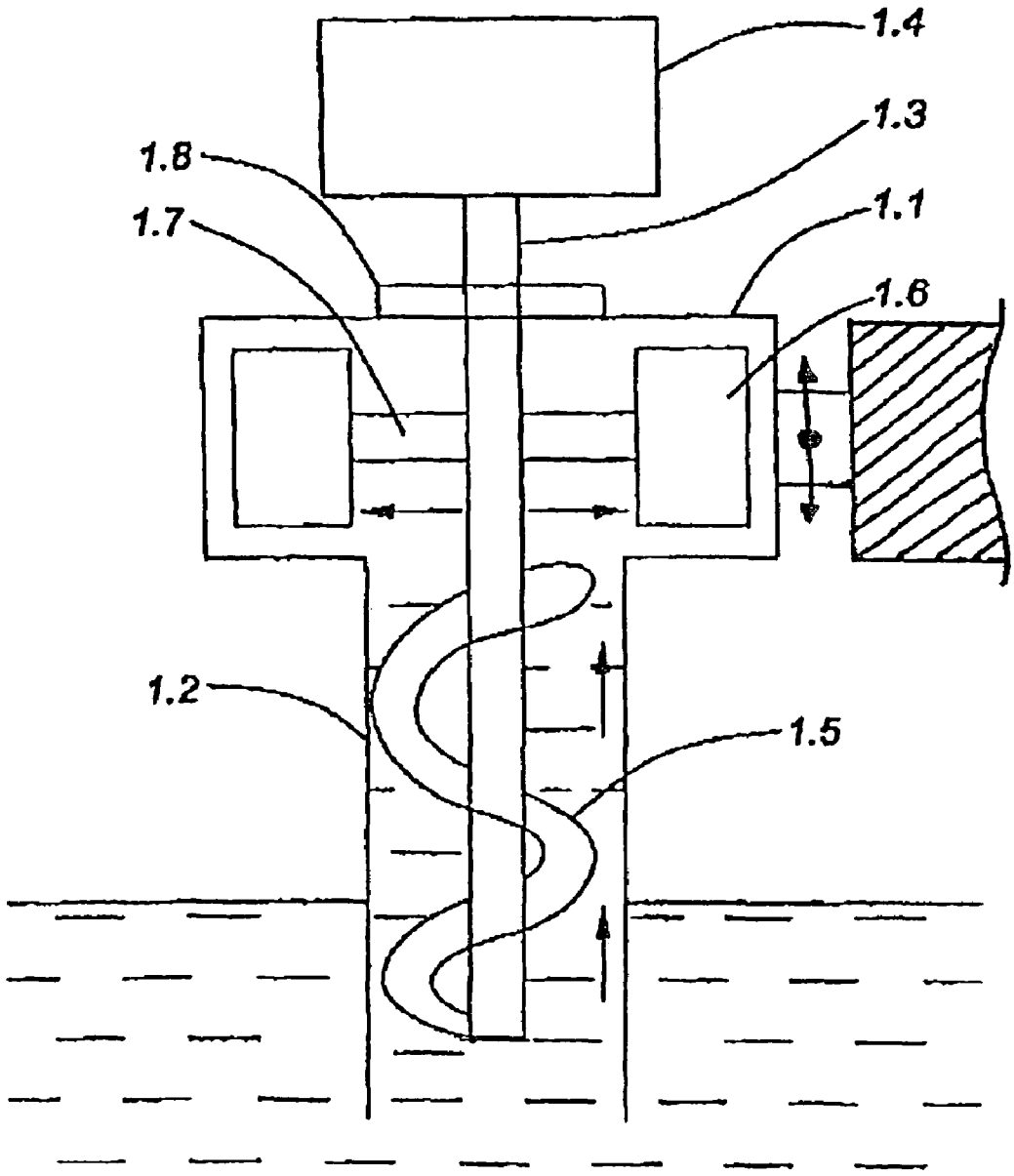

The airflow from the top opening FIG. 1 (1.8) is mixing with liquid/mud pumped creating air bubbles. This density of the mixture is decreased and the head pressure decreased. This will result in less power requirements and load on the motors.

Once the necessity of full airtight design is omitted the construction of the pump may be much lighter and cheaper to manufacturing. These will significantly increase the ratio of power to size of the pump.

The invention claimed is:

1. Apparatus for pumping drilling fluid containing drill cuttings, the apparatus comprising:

a. a vertical screw pump inserted into and at least partially submersed in the drilling fluid containing drill cuttings to lift the drilling fluid; and b. a horizontal centrifugal pump receiving the drilling fluid containing drill cuttings from the vertical screw pump, the screw pump and the centrifugal pump sharing a common drive shaft.

2. The apparatus of claim 1, with the horizontal centrifugal pump in a final stage.

3. The apparatus of claim 1, the horizontal centrifugal pump comprising horizontal centrifugal wings.

4. The apparatus of claim 3, the horizontal centrifugal wings comprising twisted 45-degree wings proximate the shaft for making air in the drilling fluid.

5. The apparatus of claim 1, the apparatus further comprising means for mixing air into the drilling fluid for decreasing the density of the drilling fluid.

6. The apparatus of claim 5, the apparatus having a casing having an opening window in the top around the shaft to inject air into the drilling fluid.

7. The apparatus of claim 1, further comprising an adjustable lift assembly for regulating a depth at which the screw pump is submersed in the drilling fluid.

* * * * *